US005539941A

United States Patent [19]

Fuller

[11] Patent Number: 5,539,941

[45] Date of Patent: Jul. 30, 1996

[54] BED PATIENT HEALTH CARE SYSTEM

[76] Inventor: Carmel U. Fuller, Postal Rte. 1, Box 480, Haysi, Va. 24256

[21] Appl. No.: 202,270

[22] Filed: Feb. 25, 1994

Related U.S. Application Data

[63] Continuation-in-part of Ser. No. 46,889, Apr. 13, 1993.

[51] Int. Cl.[6] ..... A61G 7/10; A61G 7/14

[52] U.S. Cl. ..... 5/85.1; 5/88.1; 5/900

[58] Field of Search ..... 5/81.1, 84.1, 85.1, 5/86.1, 88.1

[56] References Cited

U.S. PATENT DOCUMENTS

| | | | |
|---|---|---|---|
| 1,292,675 | 1/1919 | Augustine | 5/85.1 |
| 2,272,778 | 2/1942 | Reuter | 5/85.1 |
| 2,565,761 | 8/1951 | Dean | 5/86.1 |
| 2,603,851 | 7/1952 | Hawkins | 5/85.1 |
| 4,003,479 | 1/1977 | Reyer | 5/85.1 |
| 4,296,509 | 10/1981 | Simmons . | |
| 4,327,453 | 5/1982 | Sefton . | |
| 4,372,452 | 2/1983 | McCord | 5/85.1 |
| 4,530,122 | 7/1985 | Sanders . | |
| 4,627,119 | 12/1986 | Hachey et al. | 5/83.1 |
| 4,639,955 | 2/1987 | Carminati . | |
| 4,843,665 | 7/1989 | Cokel . | |
| 4,887,325 | 12/1989 | Tesch . | |
| 5,072,840 | 12/1991 | Ashkawa . | |
| 5,147,051 | 9/1992 | Liljedahl | 5/88.1 |
| 5,158,188 | 10/1992 | Nordberg | 5/85.1 |
| 5,185,895 | 2/1993 | Gagne . | |
| 5,315,723 | 5/1994 | Smith | 5/85.1 |
| 5,333,334 | 8/1994 | Kassai | 5/85.1 |

FOREIGN PATENT DOCUMENTS

| | | | |
|---|---|---|---|
| 2460858 | 6/1976 | Germany | 5/83.1 |

*Primary Examiner*—Michael J. Milano
*Attorney, Agent, or Firm*—Donavon Lee Favre

[57] ABSTRACT

A support frame is positioned over a hospital bed to assist in lifting and turning a patient on a sheet. In addition to the lifting mechanism, the frame has a carriage mechanism which can carry a lifted patient beyond the side or the end of the bed. The patient can also be lifted from the bed, the frame narrowed, and the patient transported to other locations in the hospital and then back to the bed without any severe physical handling. A bath water and waste water cart is used to bath a patient and to catch waste water. A drain pan is placed under the patient to catch bath water and return the water to a drain water tank on the cart.

15 Claims, 10 Drawing Sheets

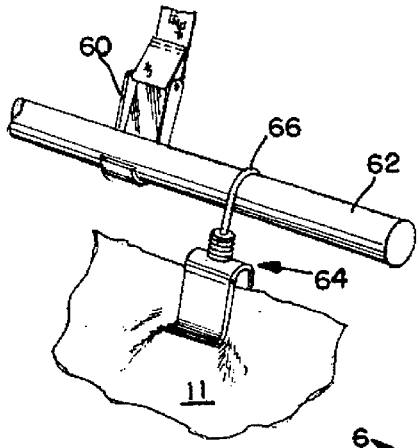
FIG. 4
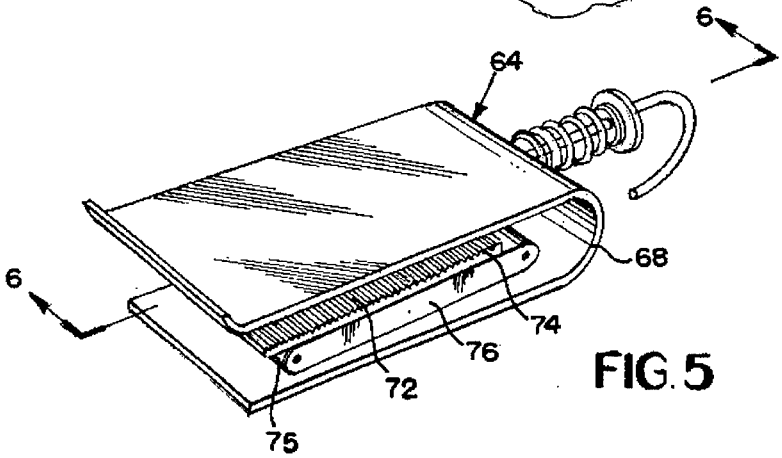
FIG. 5
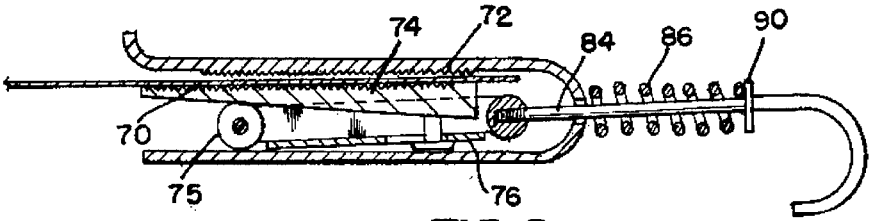
FIG. 6
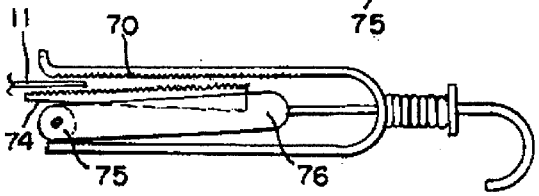
FIG. 6A
FIG. 7
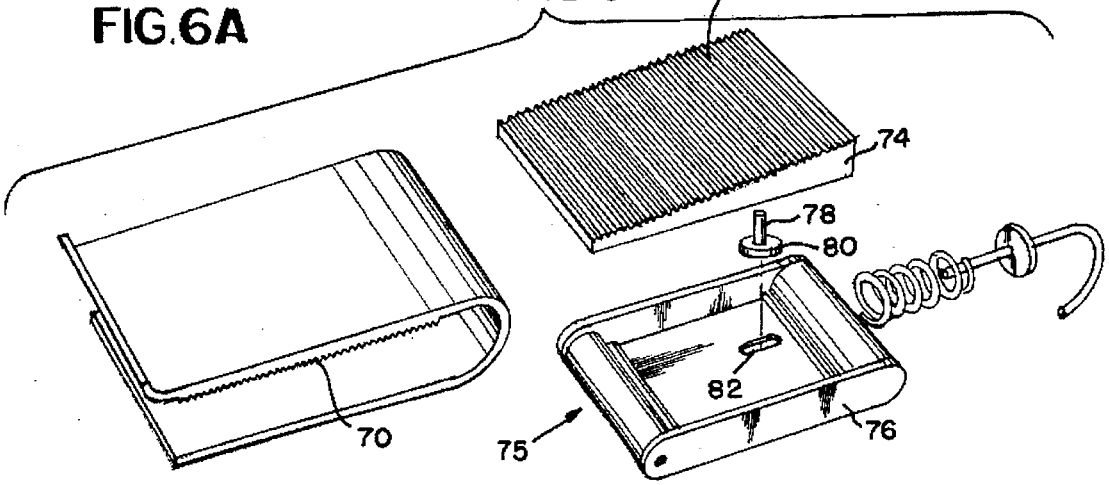

BED PATIENT HEALTH CARE SYSTEM

This application is a continuation in part of patent application Ser. No. 08/046,889 of Carmel U. Fuller, filed Apr. 13, 1993.

BACKGROUND OF THE INVENTION

This invention relates to apparatus for lifting and moving a person confined to a bed and transferring the person from the bed to another support device. The invention also relates to auxiliary apparatus for bathing the patient, and caring for the patients other sanitary needs.

The needs to lift, move, bathe, care for sanitary needs, and transfer invalids and other persons confined to a bed with temporary or permanent loss of mobility are well known. Lifting a helpless bed patient from the surface of a bed permits the changing of sheets and bed clothing and eases bathing and tending to the sanitary needs of the patient. Moving a patient is needed when a patient contacts the head or foot of the bed or comes to close to the edge of the bed and danger of falling is apt to occur. Manual lifting and moving of a bed patient are physically strenuous labor for nurses, aides and others responsible for the care of the patient. It often results in injury to the back and other body parts of the person doing the lifting and/or moving of the patient. These injuries to nurses, aides and others resulted in time lost from the job and greatly increased health care costs. Transferring a patient from bed to stretcher to operating table and back again is also stressful for the patient.

Most medical personnel who are trained to care for bed patients use a draw sheet upon which a patient rests to help in turning the patient. By pulling on one side of the draw sheet, the nurse or aide can ease turning the patient with least physical contact with the patient. The act of pulling on the patient with a draw sheet is strenuous, especially when the patient is heavy, and injuries to the nurse or aide may still occur.

The need for mechanical means for lifting, turning and transferring a bed patient has long been recognized and various devices for performing the lifting, moving or transferring of a bed patient are known.

U.S. Pat. No. 4,296,509 of Simmons et al., 1981, discloses a portable apparatus to enable a wheel chair invalid to be transferred onto and out of a bed or chair, comprising an overhead track extending over the bed or chair supported by a tripod with telescoping legs at each end, and a wheeled carriage that rides on the track. The wheeled carriage is equipped with a winch and rope tackle that hooks onto a flexible fabric sling in which the invalid sits. Activating the winch raises the sling dear of the wheel chair and the wheeled carriage is moved over the bed or chair. The sling is then lowered to the bed or chair and disconnected from the tackle. The apparatus can be broken down in sections, the tripod legs telescoped and folded, and all parts placed in an automobile trunk for transport or storage in a small space.

U.S. Pat. No. 4,327,453 of Sefton, 1982, shows a device for lifting a patient from his hospital bed and placing the patient on a wheeled transfer unit. The patients bed sheet is used as the principle lifting medium. The transfer unit can be loaded and unloaded from either side. The operation can be done by one person. Support arms are extended from the stretcher to the patient lying in bed. The arms support clamping bars that can securely grasp the patient's bed sheet.

U.S. Pat. No. 4,530,122 of Sanders et al, 1985, discloses an apparatus for at least partially lifting a patient from a bed or a wheelchair. The apparatus includes a support frame having upright supports and an overhead member, a patient sling designed to support the patient at places other than the patients's normal bed sore contact points, and a mechanism attached to the overhead support for vertically lifting the sling and patient. The support frame can be mounted to the wheelchair or bed frame or it can be free standing. The lifting mechanism can be either power driven or manually operated. The manual lifting mechanism may include an eccentrically mounted roller about which is wrapped a lifting line. A bed patient sling includes a pair of relatively stiff sides preferably shaped to conform to the lateral sides of the patient. A number of body support straps attached to the sides support the patient's body at points other than at the contact points between the patient's body and the bed. The sides are separated by adjustable, removable separator bars to keep the sling from squeezing the patient being lifted.

U.S. Pat. No. 4,843,665 of Cockel et al, 1989 discloses a patient comfort and convenience for use in conjunction with a hospital bed having a mattress between a spaced headboard and footboard and a mechanized drive for raising and lowering the mattress. There is a first support structure disposed between the footboard and the mattress, the first support structure of spaced vertical first members disposed at respective ones of a pair of foot comers of the mattress. There is also a second support structure disposed between the headboard and the mattress, the second support structure including a pair of spaced vertical second members disposed at respective ones of a pair of head corners of the mattress. A pair of rigid side rails are disposed between respective ones of the first and second members along and above upper side edges of the mattress. A fabric sling is disposed between the side rails. Preferably, the side rails are releasably attached to the tops of the vertical members and there are additionally supporting devices on wheels as, for example, a gurney cart, an ambulance stretcher, and a wheelchair to allow the patient to be maintained in the device from pickup to hospital room. The side rails each include opposed, lockable, pivoting joints whereby the side rails can be bent into a chair shape or permit the patient to sit up. There is a controller for controlling the mattress and the sling in combination through steps allowing patient turning, etc. The sling is made of a porous, non-absorbent plastic :material and there is a drain pan for placement on the mattress to catch water passing through the sling so the patient can be bathed. The sling also has a closable centrally located hole positioned under the genital area of a patient in a sling.

U.S. Pat. No. 4,639,955 discloses a device for moving a patient. The device has a support adapted to receive the body of the patient, a trolley comprising motor actuating cables connected to the support for lifting the support loaded with the patients body vertically then for translating it horizontally, at least one rail for translation over which the trolley moves: wherein on the one hand, the support, adapted to receive the patient's body, is constituted by a supple cloth, in one piece, comprising at least three successive distinct parts: a first part adapted to receive and to maintain the patient's head, a second part adapted to receive and to maintain the patient's body, a third part adapted to receive and to maintain the patient's legs and wherein, on the other hand, the trolley mobile over at least one rail comprises: a first pair of cables connected to the first part of the support, a second pair of cables connected to the third part of the support, a first, so-called lifting motor for controlling the movement of lifting and lowering of these two pairs of cables, and a second, so-called translation motor for controlling the action of horizontal translation of this trolley.

U.S. Pat. No. 4,887,325 of Tesch, 1989, discloses a patient positioning apparatus comprising a hoist and pulley assembly suspended on a frame above a bed, and connectable through adjustable straps and damping means to a sling which is positioned under the patient. When a rope connected to the hoist and pulleys is actuated by the patient or a person beside the bed, the patient is moved from either the foot of the bed toward the head of the bed or from the side of the bed toward the center of the bed. A rope gripping means is provided to clamp the rope and suspend the patient in an elevated position above the bed.

U.S. Pat. No. 5,072,840 of Asakawa et al, 1991, discloses a frame containing a hoisting assembly for a hammock suspended by lines. The frame is positioned over a bed and a person is placed in the hammock. A pair of drums are provided in the hoisting assembly so that the lines may be wound or unwound on the drums to raise of lower the hammock. Once the person is lifted, the hoisting assemble is horizontally movable so that the person may be maneuvered away from the bed and positioned in an upright sitting position over a urinal, bath or chair. The lifting and maneuvering procedure may be reversed so that the person is repositioned over the bed and returned to a substantially horizontal position by reversing the hoist direction of the drums.

U.S. Pat. No. 5,185,895 of Gagne et al, 1993, discloses apparatus for lifting patients which includes a base frame, a wheel assembly affixed to said base frame for transporting the latter over a support surface, vertically oriented guide posts affixed to said base frame, a carriage assembly slidably coupled to said guide posts, actuator means for moving said carriage along said guide posts in response to operator applied control signals, an arm member projecting out from said carriage having a patient support attachment coupled at a distal end thereof, and a motor for operating said actuator.

SUMMARY OF THE INVENTION

The present invention is directed primarily to a bed patient turning, lifting and transporting apparatus having lifting mechanisms supported on extensible arms mounted on frame members above the bed. Arms can be extended from the side of the bed to move the patient to or from the side of the bed or arms can be extended from one or more ends of the bed to move the patient to or from the end of the bed. The lifting apparatus can also be movably mounted with respect to the support arms to provide movement of a patient in two directions. In one embodiment the lifting apparatus also has side frames and end frames wherein the end frames are variable in length so that the width of the apparatus can be reduced for movement through narrow passageways. Hinges are positioned in the end frames, making the end frames foldable so that the width of the end frames can be reduced. Preferably the hinges are positioned on end frame members which are rigidly attached to the side frame members and extend a sufficient distance to render the apparatus stable and not top heavy and likely to tip over during movement. Preferably the rigidly attached end frame members extend perpendicularly from the side frame members by a distance of from six inches to eighteen inches on each side. In the alternative, rigid end frame members can have a telescoping section so that the width of the end frame members can be reduced for passage through a narrow passageway.

The present invention is directed to a body lifting, horizontally moving, and turning apparatus. The word "body" primarily refers to a hospital patient, but can include a dead body or an animal body, either dead or alive. The apparatus has an open framework for being positioned around or mounted on a support such as a bed. The apparatus can be mounted on the bed in such a way as to be part of the bed, that is built as part of the bed structure. A horizontally extendable arm is supported by the open framework, the extendable arm positioned above the bed and extendable beyond the side, or beyond the end of the bed. An elevator is supported by the horizontally extendable arm, the elevator including a motor and a winding bar mounted on the extendable arm, the winding bar being rotationally driven by the motor, the winding bar being movable by the extendable arm beyond the edge of the bed for moving the body from the bed to another support structure. In actual practice two horizontally extendable arms act is unison to move a lifted patient from a bed to a transport device.

A winding line which can be a strap, cable, rope or line is connected to the winding bar. The winding bar can be a pulley or drum or bar or any other rotating surface with or without a flange onto which the line can be wrapped. Rotation of the motor in one direction winds the strap, cable, rope or line onto the winding bar and rotation in the other direction unwinds the strap, cable, rope or line and thereby raises and lowers the strap, cable, rope or line.

A patient support strap or sheet is positioned under the body to be lifted. A patient sheet or strap is connected to the lifting line. The body is raised or lowered by the winding strap, cable, rope or line or moved in a horizontal direction by movement of the extensible arm.

The winding motor can be mounted on the extendable arm or a pulley can be mounted on the extendable arm as a conduit for the line which is wound or unwound by the winding bar driven by the motor. The extendable arm preferably rides on rollers. Other forms of known extendable arms, such as those described in the BACKGROUND OF THE INVENTION above can be employed. Preferably the rollers are mounted on a roller support member affixed to the frame. The rollers can also be mounted on the arm, a track mounted on the frame and the rollers roll on the track. The rollers preferably are round. The rollers can be pinion gears and the roller support member affixed to the frame can be a geared rack for the pinion gears.

The body lifting, turning and horizontally moving apparatus has first and second side frame members, each side frame member having two ends. A hinged scissor truss joins one end of the first side frame member and to a corresponding end of the second side frame member, allowing the width of the end flames to be reduced for movement through restricted passageways. By a hinged scissor truss is meant a truss formed of a series of two bars joined to form an X at the joint. The bars are joined at a pivot. To form the pivot a round pin extends through an opening in each of the two bars. The two side ends of each two bars joined to form an X are joined to two side ends of an adjacent two bars joined to form an X at a pivot. This pattern is repeated until the necessary length is achieved. The two bars at each end of the scissor truss are joined to each respective side frame member by a hinge pins through an opening in each bar and extending through a flange on a side frame member joining the bar at the side frame member. At least one opening in each flange is elongated to allow for expansion and contraction of the hinged scissor truss. The elongated slot is necessary because as the scissor truss is extended, each X formed by the bars becomes shorter in height. One terminal bar of the hinged scissor truss is preferably joined to a flange on the frame member by a pin fitting into an elongated slot in a flange to allow the height of the hinged scissor truss to increase and decrease with a corresponding increase and decrease in the length of the hinged scissor truss. The second terminal bar is preferably joined to the flange by a pin fitting tightly through the end of the bar into an opening in a flange on the same frame member. The tight fitting pin is not so tight that rotation is permitted, but is tight enough that no visible sagging of the truss is noticed. Another method of attaching the ends of the scissor truss to the frame member is by attaching a vertical rod to each frame member and sleeves which fit over the rod to each end bar of the hinged scissor truss. A locking mechanism holds the scissor truss in a contracted or extended configuration.

Another way of varying the width of the body lifting, turning and horizontally moving apparatus is to provide a collapsible hinged section in the end frame members. A first section of each end frame member is rigidly attached to a corresponding side frame member and extends to provide sufficient width to render the apparatus stable and not likely to tip over during movement, hinges are positioned on ends of the first section of each of the end frame members, a vertically folding extension is attached to each hinge positioned on an end of each first section of each end frame member. The first section of each end frame members extend perpendicular from the side frame members by a distance of from 6 inches to 18 inches to prevent the width of the frame being decreased to a width that would make it top heavy and likely to tip over during movement.

Another way of varying the width of the body lifting, turning and horizontally moving apparatus is to attach first sections of each end frame member to the side frame members. Position wheels in upper and lower portions of each first section, the wheels spaced at a distance equal to the height of an extendable end frame member. Insert an extendable end frame member into two first sections of the end frame at each end of opposed side frame members. The side frame members can then be moved apart or closer together by the extendable end frame members riding on the wheels in the extendable end frame members.

A locking mechanism, in each instance, holds the end frame in a contracted or extended configuration. Other species showing contraction and extension of the width of the apparatus of the present invention are shown in FIGS. 1–21 of parent application Ser. No. 08/046,889 of Carmel U. Fuller, filed Apr. 13, 1993. The drawings of the parent application as well as the corresponding DETAILED DESCRIPTION OF THE INVENTION of the parent application are hereby incorporated into the present application.

A significant advantage of the present motor driven lifting device mounted on a frame for lifting a body from a support is that the motor mounted on the frame above the body. This eliminates the need for cables running up, over pulleys and down again to the hammock supporting the body. There is always the danger of cables being tangled or getting in the way, and the shorter the cable length the better. Support straps from the motor driven lifting device to the body support are preferred because there is even less danger of entanglement. For smaller units it is preferred that the motors and lift mechanism be mounted on the inside of the frame to prevent the lifting lines from coming into contact with frame members. Small, portable units, for example, but not limited to units having a height of less than six feet and a length of from three feet up to six feet can be employed or incorporated into a bed design.

Another significant advantage of the lifting device of the present invention is that the motor is mounted on an extensible arm which allows the body to be lifted then moved from the support to a second support. Also the motors can be operated independently to lift or lower the upper part of the body, or the side of the body. The motors can also be moved different horizontal distances to place the body on other moving devices which may not be perfectly parallel to the support the body is initially on.

Another significant advantage of the lifting device of the present invention is that the frame is collapsible in the widthwise direction to a width less than three feet to allow the frame to be wheeled through a doorway or narrow passageway.

In a preferred embodiment, clamps are supported by the lifting straps, and the clamps are clamped onto a bed sheet to lift a patient. A clamp having teeth or sharp ridges on the gripping surfaces preventing the sliding of the sheet through the clamp is attached to the sheet. Wedging or spring pressure holds the gripping clamp surfaces in place during lifting. After lifting, the clamp can be removed from the sheet by removing pressure from the gripping surfaces holding the sheet.

The preferred clamp is the clamp of the present invention. The clamp of the present invention has a housing in the shape of a "U" having an opening represented by the open side of the "U" and a curved section represent by the curved section of the "U". One large, flat, inner surface of the clamp has a series of protrusions which provide a holding surface for the sheet. A tapered plate having a flat surface having a series of protrusions which oppose the protrusions on the house to provides an opposing holding surface for the sheet. The plate rides in a carriage for the plate, the plate being slidable in the carriage and the carriage being slidable in the housing. A roller is positioned in the end of the carriage at the direction of the opening of the "U", the roller forcing the tapered plate in the direction of the protrusions on the inner surface of the "U", the tapered plate being narrower in the direction of the opening in the "U" . Movement of the carriage in the direction of the opening causes the damp to tighten A shank is attached to the carriage, the shank extending through the curved section of the "U". A spring forces the shank in a direction away from the housing whereby the carriage is drawn away from the opening thereby causing the roller to move to a thicker portion of the tapered plate tightening the clamp.

The bed patient lifting device of the present invention can also be used to assist in bathing a patient. The patient is lifted from his bed and placed on a padded drain pan. Bath water is supplied from a bath cart and water collected from the drain pan returns to a grey tank on the bath cart. The bath cart for bathing patients is a wheeled cart having a fresh water tank mounted on the cart for holding bath water, and a grey water tank on the cart for holding water that has been used to bath a patient.

BRIEF DESCRIPTION OF DRAWINGS

FIG. 4 is a perspective view showing the sheet clamp of the present invention gripping a sheet.

FIG. 5 is a perspective view showing the clamp in the open position.

FIG. 6 is a sectional view of the clamp taken along lines 6—6 of FIG. 5.

FIG. 6A is a section view of the clamp attached to a sheet.

FIG. 7 is an exploded view of the clamp showing the component parts.

DETAILED DESCRIPTION OF THE PREFERRED EMBODIMENTS OF THE INVENTION

Figure 1:
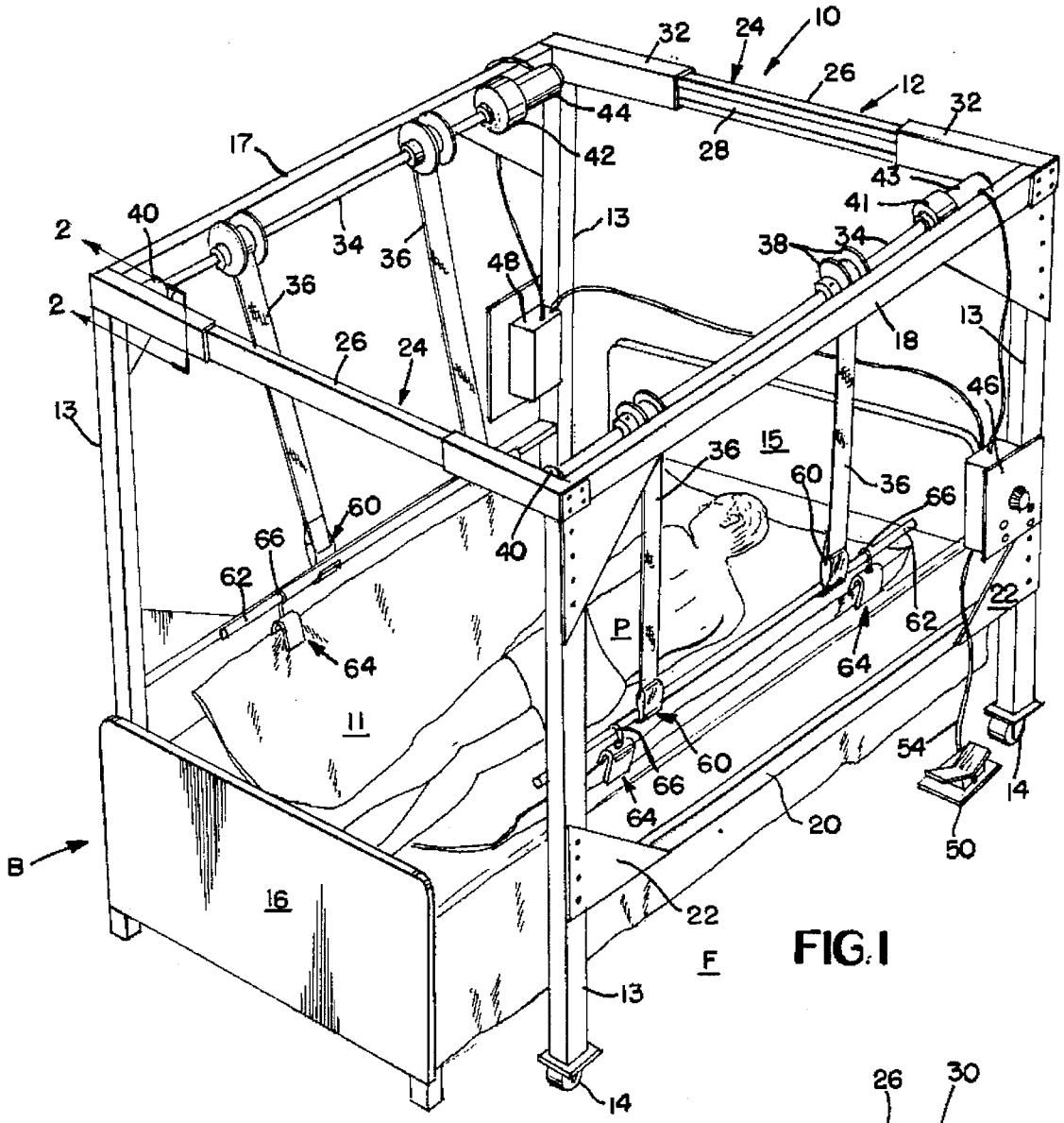
FIG. 1 is a perspective view of the apparatus of this invention shown straddling a hospital bed on which a patient is lying.

Referring now to the drawings and specifically to FIG. 1 an apparatus for lifting, turning and moving a bed patient is generally indicated by the reference numeral 10. The apparatus 10 is shown in a position wherein it straddles a bed B on which a patient P is lying. A sheet 11 is positioned on the surface of the bed under the patient P. The lifting, turning and moving apparatus 10 includes an open frame 12, comprising four vertical posts 13 arranged at corners of a rectangle. Each post 13 is supported upon the floor F by a caster wheel 14 having suitable braking mechanism for locking the wheel against rotation when it is desired to maintain the frame in a stationary position and for unlocking the wheel when it is desired to move the frame. The posts 13 at each end of the frame 12 are spaced by a distance sufficiently greater than the width of the normal hospital bed so that the frame can be rolled longitudinally from one end of the bed to a position straddling the bed. Each end of the frame 12 between end posts must be open for a sufficient height above the floor so that the frame will not encounter the head and foot boards 15 and 16 respectively of the bed frame as it is rolled into position straddling the bed. For a small frame 12 it is only necessary that the frame not encounter the foot board 16.

The left hand corner posts 13 on opposite ends of the frame 12 (looking forward from the foot of the frame toward the head as seen in FIG. 1) are connected by an upper longitudinal side frame member 17. Similarly the right hand corner posts 13 at opposite ends of the frame are connected by an upper longitudinal side frame member 18. The upper longitudinal side frame members 17 and 18 are preferably rigidly secured to the upper ends of posts 13 by welds or by other suitable rigid securing means.

Each of the comer posts 13 has a lower horizontal tubular section 20 rigidly connected at one end to the post and extended perpendicularly therefrom to the opposite lengthwise end of the frame 12 where the tubular section 20 is rigidly connected to a second corner post 13. Flat angle braces 22 extend between a side of each post 13 above the tubular horizontal section 20 and a position on a vertical side of the tubular horizontal section 20 outwardly from the post 13.

Figure 3:
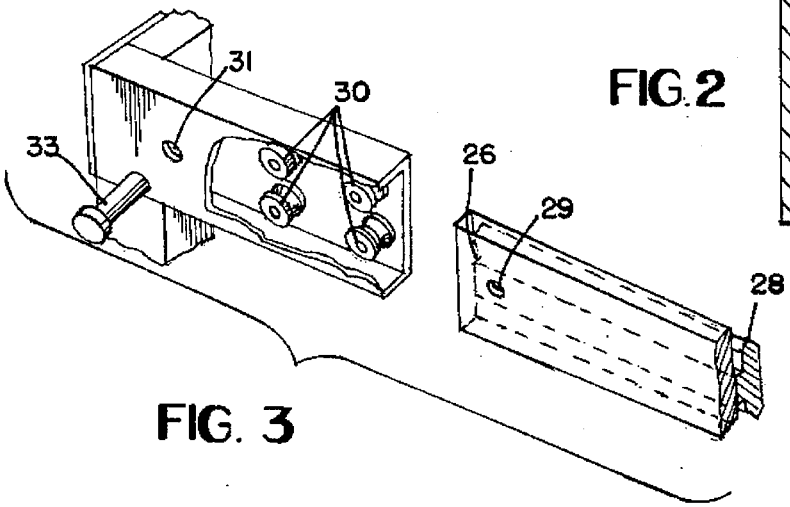
FIG. 3 shows one of a series of pin holes used to lock the movable portion of the support beam to the stationary portion of the support beam.

The vertical posts 13, at each end of the frame 12, are connected adjacent the tops of the posts by an extentable transverse end frame assembly 24 of rectangular configuration. The extendable transverse end frames 24 each comprise a horizontal, extendabale frame member 26 attached to a rail 28. There are a series of holes 29 extending through extentable frame member 26 and rail 28 (see FIG. 3). Each rail 28 rolls on parallel rows of a plurality of horizontally spaced and vertically spaced rollers 30 which are secured to an internal surface of a tubular, horizontally extending end frame member 32. There are a series of holes 31 in end frame member 32 positioned to mate with holes 29 through extentable frame member 26. When one or more holes 31 through end frame member 32 mate with one or more holes in extentable frame member 26, pin 33 can be inserted through the mating holes to prevent further movement of the extentable end frame member. The rail 28 is also known as a slideway and the plurality of rollers 30 are also known as a carriage. The rail 28—assembly of rollers 30 are commercially available units and are not described in detail in the present application.

A shaft 34 is mounted on each side of the frame 12 inwardly from and parallel to the upper longitudinal frame members 17 and 18. A plurality of straps 36 are mounted on each shaft 34 for winding and unwinding as the shaft is tamed. There is a pair of the guide disks 38 mounted on the shaft 34 for each strap 36. The guide disks of each pair are separated by a distance slightly greater than the width of each strap so that the strap may be freely wound upon itself between the guide disks.

One end of each shaft 34 is rotatably mounted in a bearing 40. The other end of shaft 34 is coupled to the end of an output shaft projecting from a speed reduction gearing 41 and 42. Speed reduction gearing 41 and 42 is driven by motors 43 and 44. Frame members 17 and 18 at the of the frame 12 at the head ends thereof respectively, provide support for the motors and reduction gearing. The motor control boxes 46 and 48 are mounted lower on corner posts 13 where they are easy to reach. Foot switches 50 and 52 are electrically connected by electrical cables 54 and 56 to motor control boxes 46 and 48. The foot switches 50 and 52 allow independent control of motors 43 and 44 which in turn allow independent control of the lifting straps 36 on either side of the patient P. Switch 52 is on the opposite side of the frame from switch 50 and is not shown in FIG. 1.

Lifting hooks 60 on the ends of lifting straps 36 engage rods 62. Sheet 11 is supported by spring loaded clamps 64 which are attached to rods 62 by clamp hooks 66. The attachment is clearly shown in FIG. 4. Spring loaded sheet clamp 64 has a housing 68 shown as a "U" turned on its side in FIGS. 5 through 7. The lower surface of the top extension of the "U" has a series of grooves 70 which mate with a series of grooves 72 on tapered bottom plate 74. Tapered bottom plate 74 is slidably positioned in slidable carriage 76. A pin 78 having a head 80 extends through a slot 82 in carriage 76 and is affixed to plate 74 limiting the lengthwise movement of plate 74. Carriage 76 is attached to shank 84 of clamp hook 66. A spring 86 is positioned between the curve of the "U" and a stop 90 on the shank 84 of clamp hook 66. The spring 86 causes the carriage to move to an area of thicker taper of plate 74 which rides on roller 75

To attach clamp 64 to a sheet, spring 86 is compressed moving carriage 76 forward. The edge of sheet 11 is inserted between grooves 70 and grooves 72 sliding bottom plate 74 toward the spring 86 and opening clamp 64. When spring 86 is decompressed, carriage 76 moves toward the spring a greater distance than tapered bottom plate 74 resulting in clamp 64 closing on sheet 11.

Figure 8:
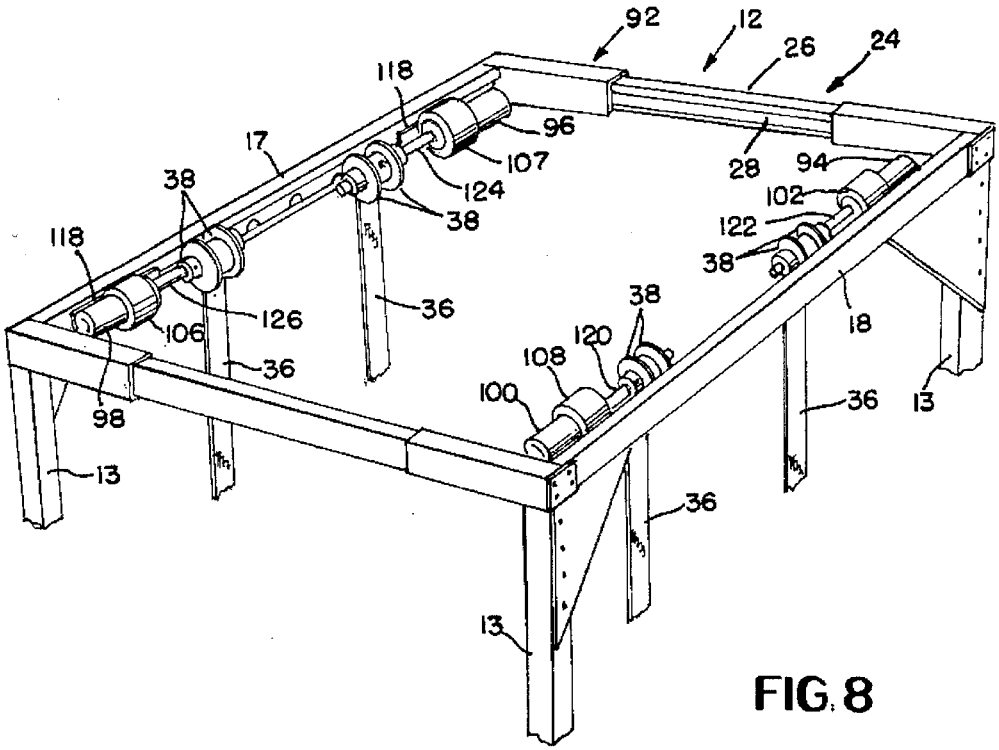
FIG. 8 is a partial perspective view of the top of the frame for a second embodiment, utilizing four individual motors for moving the clamp straps.

An embodiment of the present invention having four independently controlled motors and corresponding lifting straps is shown in FIG. 8. The lifting and turning apparatus 92 is like that of FIG. 1 in that it includes an open frame 12, comprising four vertical posts 13 arranged at corners of a rectangle. Each post 13 is supported upon the floor F by a caster wheel 14 (not shown) having suitable braking mechanism for locking the wheel against rotation when it is desired to maintain the frame in a stationary position and for unlocking the wheel when it is desired to move the frame. The posts 13 at each end of the frame 12 are spaced by a distance sufficiently greater than the width of the normal hospital bed so that the frame can be rolled longitudinally from one end of the bed to a position straddling the bed. Each end of the frame 12 between end posts must be open for a sufficient height above the floor so that the frame will not encounter the head and foot boards 15 and 16 respectively of the bed frame as it is rolled into position straddling the bed. For a small frame 12 it is only necessary that the frame not encounter the foot board 16.

The left hand comer posts 13 on opposite ends of the frame 12 (looking forward from the foot of the frame toward the head as seen in FIG. 1) are connected by an upper longitudinal side frame member 17. Similarly the right hand comer posts 13 at opposite ends of the frame are connected by an upper longitudinal side frame member 18. The upper longitudinal side frame members 17 and 18 are preferably rigidly secured to the upper ends of posts 13 by welds or by other suitable rigid securing means.

Each of the comer posts 13 has a lower horizontal tubular section 20 (see FIG. 1) rigidly connected at one end to the post and extended perpendicularly therefrom to the opposite lengthwise end of the frame 12 where the tubular section 20 is rigidily connected to a second corner post 13. Flat angle braces 22 extend between a side of each post 13 above the tubular horizontal section 20 and a position on a vertical side of the tubular horizontal section 20 outwardly from the post 13.

Figure 2:
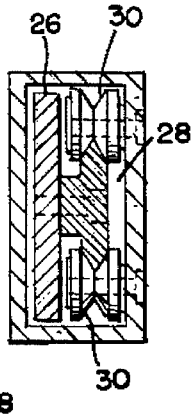
FIG. 2 is a view taken along lines 2—2 of FIG. 1 showing rollers mounted on a stationary portion of a support beam.

The vertical posts 13, at each end of the frame 12, are connected adjacent the tops of the posts by an extentable transverse end frame assembly 24 of rectangular configuration. The extendable transverse end flames 24 each comprise a horizontal, extendabale frame member 26 attached to a rail 28. Each rail 28 rolls on parallel rows of a plurality of horizontally spaced and vertically spaced rollers 30 which are secured to an internal surface of a tubular, horizontally extending end frame member 32 (see FIGS. 2 and 3). The rail 28 is also known as a slideway and the plurality of rollers 30 are also known as a carriage. The rail 28—assembly of rollers 30 are commercially available units and are not described in detail in the present application.

Figure 10:
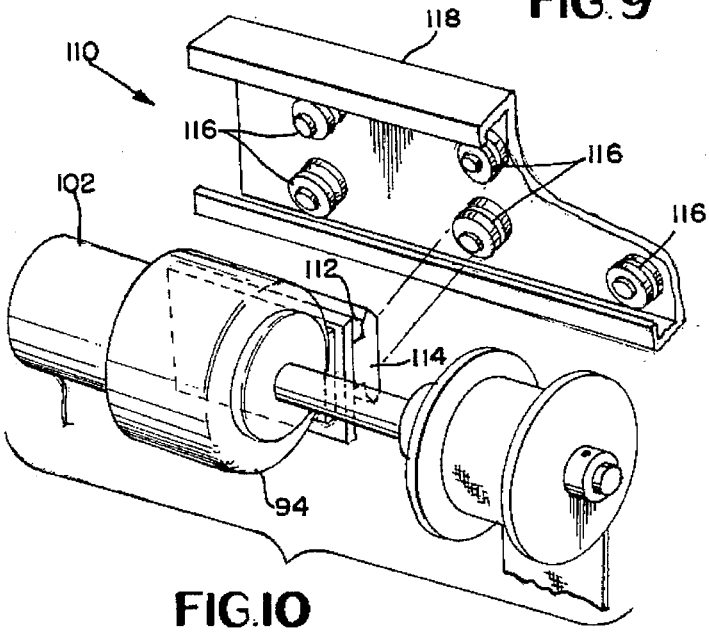
FIG. 10 is a partial perspective view of one of the motors, showing how it is mounted on a sliding frame member which in turn travels between a plurality of rollers affixed to the side frame.
Figure 11:
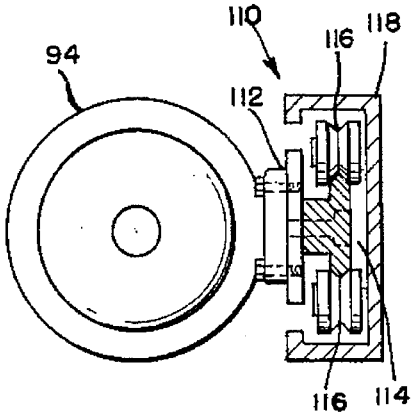
FIG. 11 is an end sectional view taken along lines 11—11 of FIG. 9.

Four motors 94, 96, 98, and 100 along with associated clutches and reduction gearing 102, 104, 106, and 108 are slidably mounted on carriages 110 at the head and foot ends respectively of frame members 17 and 18. The four carriages 110 are similar in structure to extendable transverse end frames 24 and each comprise a horizontal, motor carrier 112 attached to a rail 114. Each rail 114 rolls on parallel rows of a plurality of horizontally spaced and vertically spaced rollers 116 which are secured to an internal surface of a horizontally extending, flanged, channel support member 118 (see FIGS. 10 and 11).

Figure 9:
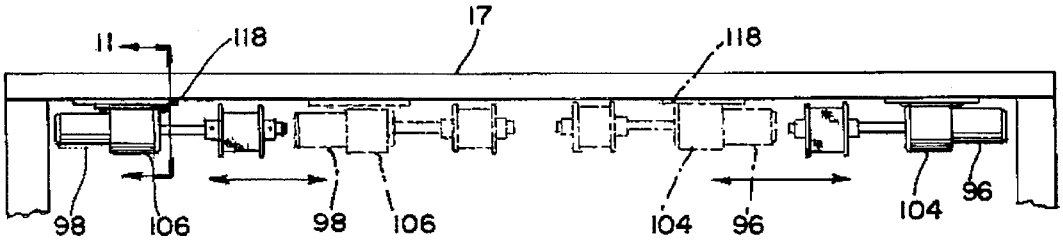
FIG. 9 is a top fragmentary view of the frame, showing how the motors are moved in and out along the side rails of the frame. This movement is shown in phantom lines.

Each shaft 120, 122, 124 and 126 is an output shaft projecting from speed reduction gearing 102, 104, 106 and 108. The speed reduction gearing is driven by motors 94, 96, 98 and 100. Frame members 17 and 18 of the frame 12 provide support for the motors, reduction gearing, rails, rollers and channel support members. As is shown in FIG. 9, each motor can be individually positioned along a particular section of its corresponding frame member. As is shown in FIG. 1 the motor control boxes 46 and 48 are mounted lower on corner posts 13 where they are easy to reach. Foot switches 50 and 52 are electrically connected. Foot switch 52 is on the opposite side of the bed from switch 50 and is not shown in FIG. 1. There is a pair of the guide disks 38 mounted on each of shafts 120, 122, 124 and 126 for each strap 36 The guide disks of each pair are separated by a distance slightly greater than the width of each strap so that the strap may be freely wound upon itself between the guide disks. By the use of the motor controls 46 and 48 and foot switches 50 and 52, motors 100, 102, 104 and 106 can be individually and/or simultaneously controlled to selectively lift the top, bottom and/or either side of sheet 11 that the patient P is lying on.

Figure 12A:
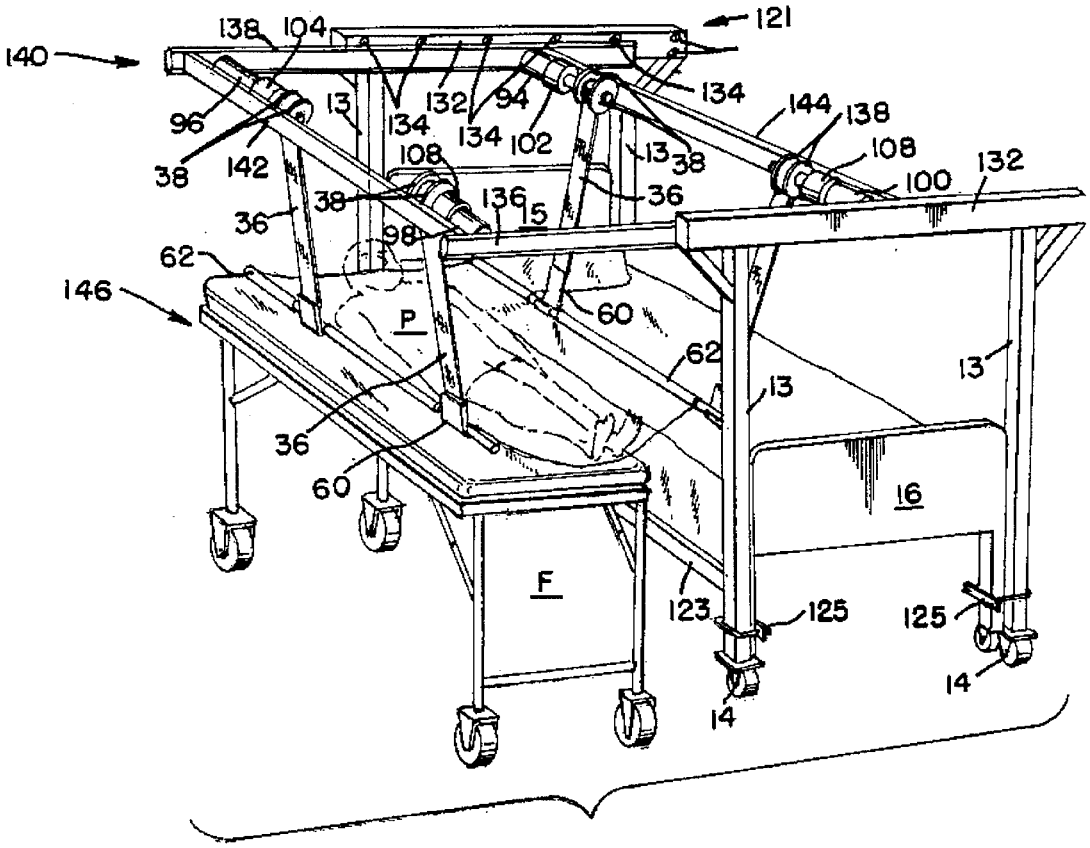
FIG. 12A is an overall perspective view of another embodiment of the support frame showing an internal sliding frame member used to move a patient out over the side of the bed to a gurney or wheel chair.
Figure 13:
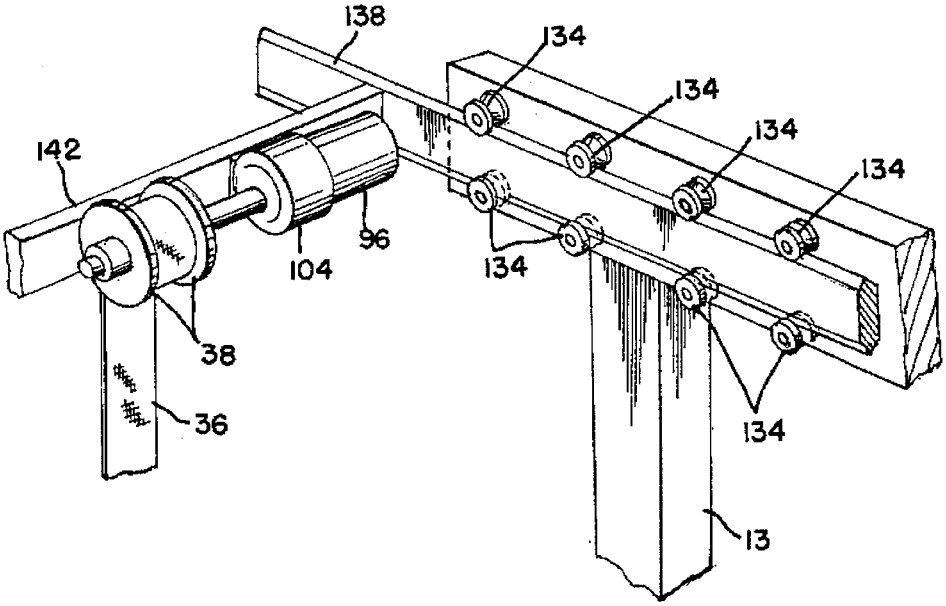
FIG. 13 is a partial perspective view of a portion of the internal sliding frame member showing how it is supported by a series of rollers.
Figure 12B:
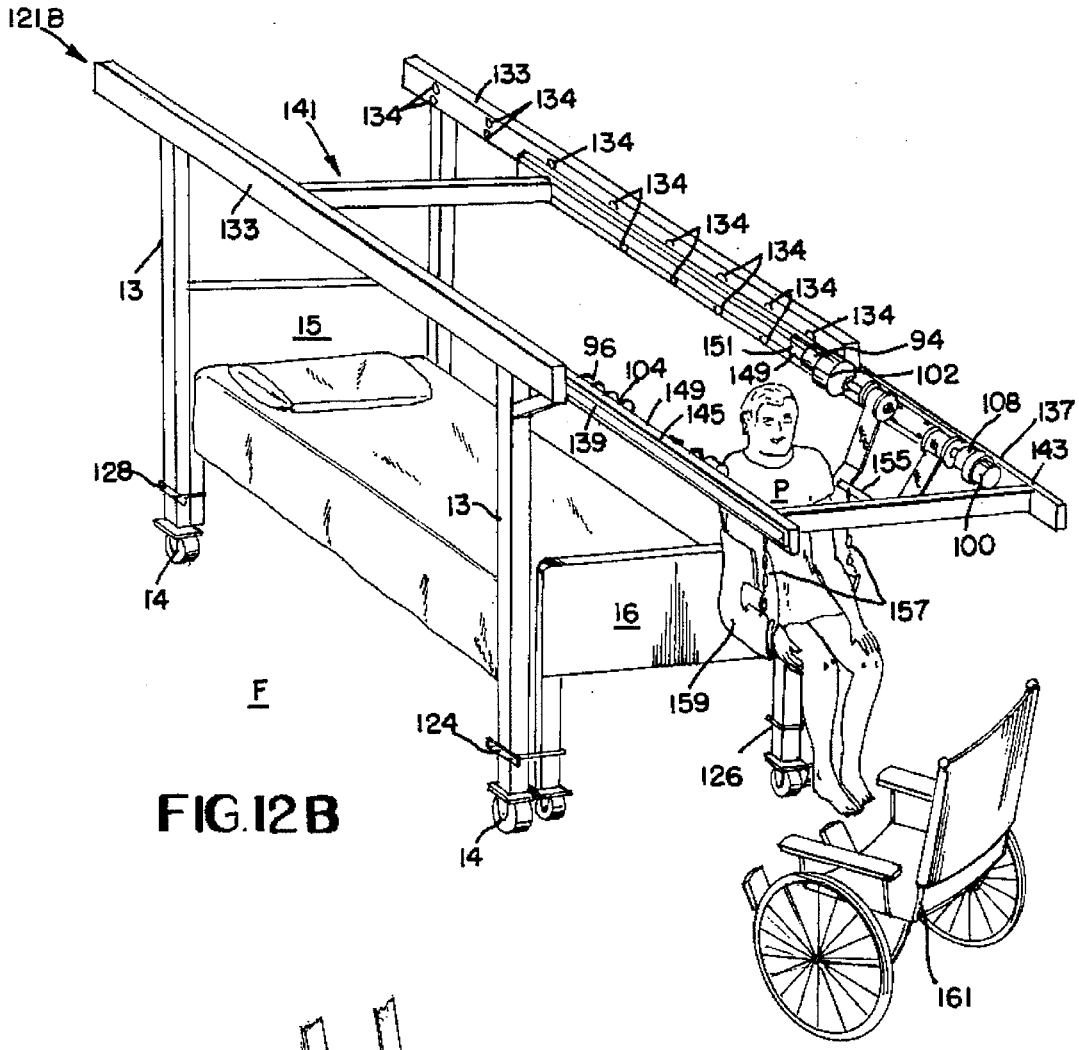
FIG. 12B is an overall perspective view of a variation of the support frame of FIG. 12A showing a double internal sliding frame member used to move a patient out over the end of a bed to a wheel chair.
Figure 12C:
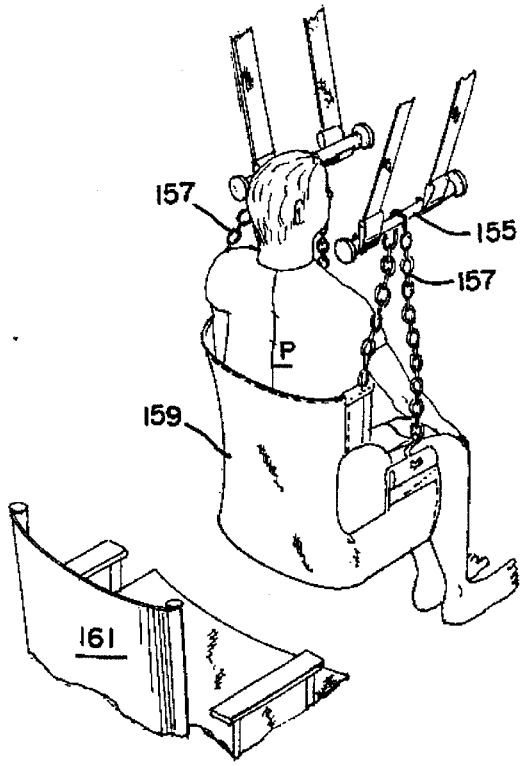
FIG. 12C is a perspective view of the sling used in conjunction with the support, frame of FIG. 12 to move a patient out over the end of bed to a wheel chair.

Another embodiment of the present invention, used to transfer a patient to or from a wheeled transfer unit or gurney, is shown in FIGS. 12 and 13. In all transfers to and from all embodiments of the present invention a support surface is always directly under a patient being transferred as an insurance against an injuring fall. The lifting, turning and transferring apparatus is like that of FIG. 8 in that it includes an open frame 121, comprising four vertical posts 13 arranged at corners of a rectangle. Each post 13 is supported upon the floor F by a caster wheel 14 having suitable braking mechanism for locking the wheel against rotation when it is desired to maintain the frame in a stationary position and for unlocking the wheel when it is desired to move the frame. The posts 13 at each end of the frame 121 are spaced by a distance sufficiently greater than the width of the normal hospital bed so that the frame can be rolled longitudinally from one end of the bed to a position straddling the bed. Each end of the frame 121 between end posts must be open for a sufficient height above the floor so that the frame will not encounter the head and foot boards 15 and 16 respectively of the bed frame as it is rolled into position straddling the bed. For a small frame it is only necessary that the frame not encounter the foot board 16.

The corner posts 13 on opposite ends of the frame 121 (looking forward from the foot of the frame toward the head as seen in FIG. 1) are optionally connected by lower longitudinal side frame members 123. The lower longitudinal side frame members 123 are preferably rigidly secured to a lower section of posts 13 by welds or by other suitable rigid securing means. The side frame members provide rigidity to the frame 120. Frame 121 is clamped to bed B by bed clamps 125 (not shown) on the legs blocked from view. The clamping provides rigidity in the absence of lower longitudinal side frame members, and also prevents the frame 121 from turning over when a patient is moved out over the side of the bed.

The vertical posts 13, at each end of the frame 120, are connected adjacent the tops of the posts by a transverse end frame 132 of rectangular configuration. The transverse end frames 132 each contain two parallel rows of a plurality of horizontally spaced and vertically spaced rollers 134 which are secured to a bed facing, side surface of each end frame member 132. Rails 136 and 138 run between each of the two parallel rows of rollers 134. The rails 136 and 138 constitute the ends of a slidable sub time 140. Longitudinal side sub frame member 142 is joined to the left hand side of rails 136 and 138 and longitudinal side sub frame member 144 is joined to the right hand side of the rails. Four motors 94, 96, 98, and 100 along with associated clutches and reduction gearing 102, 104, 106, and 108 are mounted at the head and foot ends respectively of sub frame members 142 and 144.

Each shaft 120, 122, 124 and 126 is an output shaft projecting from speed reduction gearing 102, 104, 106 and 108. The speed reduction gearing is driven by motors 94, 96, 98 and 100. The mounting of the motor control boxes 46 and 48 and the positioning of foot switches 50 and 52 are not shown in conjunction with FIG. 12, but are shown or described in relation to FIGS. 1 AND 8. There is a pair of the guide disks 38 mounted on each of shafts 120, 122, 124 and 126 for each strap 36 The guide disks of each pair are separated by a distance slightly greater than the width of each strap so that the strap may be freely wound upon itself between the guide disks. By the use of the motor controls 46 and 48 and foot switches 50 and 52, motors 100, 102, 104 and 106 can be individually and/or simultaneously controlled to selectively lift the top, bottom and/or either side of sheet 11 supporting patient P. Sheet 11 is supported by rods 62. The edge of sheet 11 is folded over upon itself to form a channel for rod 62, and the edge of the sheet is sewn to the body of the sheet to make the channel permanent. The rods are supported by strap hooks 60.

In the operation of sliding sub frame 140, the patient is first lifted by operation of the above described motor controls, foot switches, motors and straps attached to the sheet supporting the patient. A gurney 146 is then placed next to bed 16. Sliding frame 140 is then slid over gurney 146 carrying patient P to a position above gurney 146. Patient P is then lowered, and strap hooks 60 removed from rod 62. The patient P is now free to be moved to a new location on the gurney. As an alternative, the strap hooks 60 can be replaced by sheet clamps 64 directly holding sheet 11 without rod 62 being inserted through sheet 11. A wheel chair folded flat to form a gurney such as one of those of U.S. Pat. Nos. 4,797,960; 4,813,088; or 4,821,3562 can be placed next to bed 16. Sliding frame 140 can then be slid over the wheel chair folded flat and the patient lowered onto the flattened wheel chair. Clamps 64 can then be removed and the wheelchair folded into an upright sitting position.

The lifting, turning and transferring apparatus of FIG. 12B is like that of FIG. 12A in that it includes an open support frame 121B, comprising four vertical posts 13 arranged at corners of a rectangle. Each post 13 is supported upon the floor F by a caster wheel 14 having suitable braking mechanism for locking the wheel against rotation when it is desired to maintain the frame in a stationary position and for unlocking the wheel when it is desired to move the frame. The posts 13 at each end of the frame 121B are spaced by a distance sufficiently greater than the width of the normal hospital bed so that the frame cab be rolled longitudinally from one end of the bed to a position straddling the bed. Each end of the frame 121 between end posts must be open for a sufficient height above the floor so that the frame will not encounter the head and foot boards 15 and 16 respectively of the bed frame as it is rolled into position straddling the bed. For a small frame it is only necessary that the frame not encounter the foot board 16.

Frame 121B is clamped to bed B by bed clamps 125 (not shown on the legs blocked from view). The damping provides rigidity in the absence of lower longitudinal side frame members, and also prevents the frame 121B from turning over when a patient is moved out over the end of the bed.

The vertical posts 13, at each side of the support frame 121B, are connected adjacent the tops of the posts by a longitudinal side frame 133 of rectangular configuration. The longitudinal side flames 133 each contain two parallel rows of a plurality of horizontally spaced and vertically spaced rollers 134 which are secured to a bed facing, side surface of each longitudinal side frame member 133. Rails 137 (not shown) and 139 run between each of the two parallel rows of rollers 134. The rails 137 and 139 constitute the sides of a slidable sub frame 141. Longitudinal side sub frame member 143 is joined to the right hand side of rail 137 and longitudinal side sub frame member 145 is joined to the right hand side of rail 139. See FIG. 13 for a comparable rail-frame combination. Four motors 94, 96, 98, and 100 along with associated clutches and reduction gearing 102, 104, 106, and 108 are mounted, two at each end of sub-sub frame members 147 and 149 (not shown). Sub-sub frame members 147 and 149 are attached to rails 151 and 153 (not shown) which ride on rollers 134 on the bed facing surfaces of sub frame members 143 and 145. Again attention is directed to FIG. 13 for camparable rail-frame combinations.

Each shaft 120, 122, 124 and 126 is an output shaft projecting from speed reduction gearing 102, 104, 106 and 108 (See FIG. 8 for a clear showing of comparable output shafts and speed reduction gearing). The speed reduction gearing is driven by motors 94, 96, 98 and 100. The mounting of the motor control boxes 46 and 48 and the positioning of foot switches 50 and 52 are not shown in conjunction with FIG. 12B, but are shown or described in relation to FIGS. 1 AND 8. There is a pair of the guide disks 38 mounted on each of shafts 120, 122, 124 and 126 for each strap 36 The guide disks of each pair are separated by a distance slightly greater than the width of each strap so that the strap may be freely wound upon itself between the guide disks. By the use of the motor controls 46 and 48 and foot switches 50 and 52, motors 100, 102, 104 and 106 can be simultaneously controlled to lift rods 155. Chains 157 go over rods 155 and are in turn attached to sling 159 supporting patient P.

In the operation of sliding sub frame 141, the patient is first lifted by operation of the above described motor controls, foot switches, motors and chains supporting the sling supporting the patient. A wheel chair 161 is placed next to bed 16. Sliding sub-frame 141 is then slid over the wheel chair 161. Patient P is then lowered into the wheel chair, and chains 157 removed from rods 155 and sling 159. The patient P is now free to be moved to a new location in the wheel chair.

Figure 14:
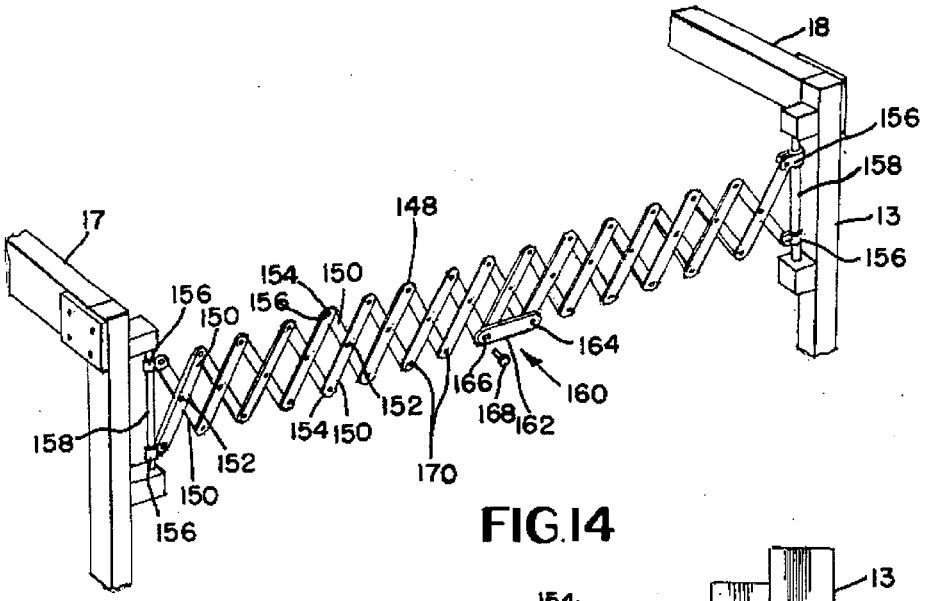
FIG. 14 shows an embodiment of the frame having a folding scissor truss center section to reduce the width of the frame for passage through narrow passageways while supporting a patient.
Figure 15:
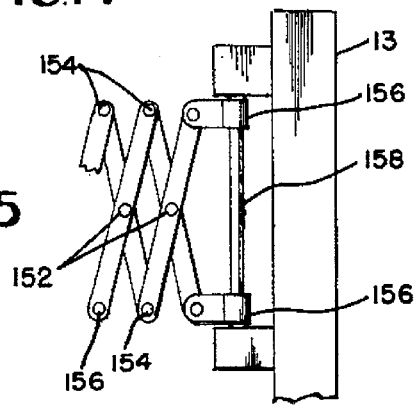
FIG. 15 is a fragmentary view of one comer of the frame of FIG. 14 showing how the folding scissor truss appears in the reduced width position. Note that there are two slidable bearing pieces which move up and down the rod as the truss is extended or contracted.
Figure 16:
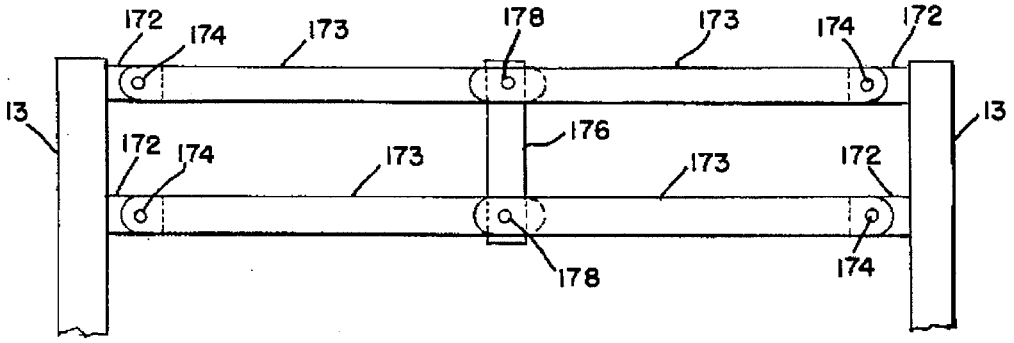
FIG. 16 shows an embodiment wherein the width of the frame is extended or contracted by means of two sets of hinged, parallel, folding arms.
Figure 17:
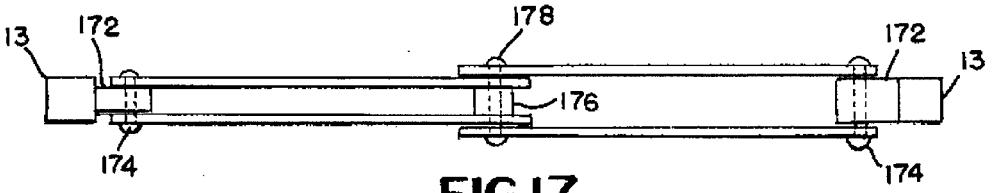
FIG. 17 is a top plan view of the parallel arms shown in FIG. 16.
Figure 18:
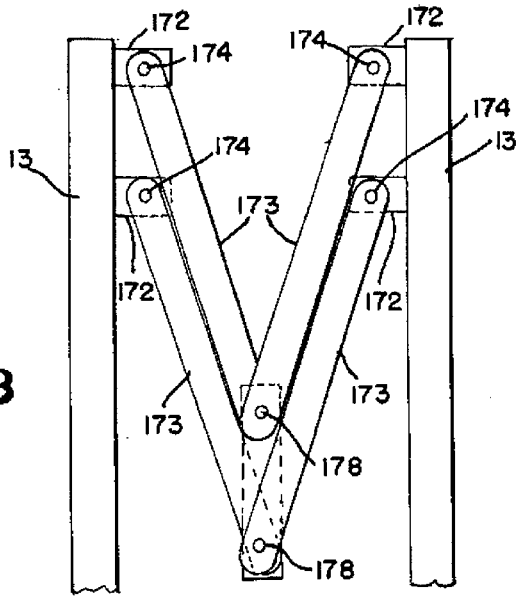
FIG. 18 is a front elevation of the folding arms embodiment of FIG. 16 in the contracted or folded position.

The present invention also includes a number of embodiments for reducing the width of the frame of the lifting, turning and moving apparatus of the present invention. FIG. 14 shows the end of a lifting, turning and moving frame. Right and left corner posts 13 at one end of the frame are joined by a hinged scissor truss 148. Collapsing hinged scissor truss 148 allows the width of the end frames to be reduced for movement through restricted passageways. The hinged scissor truss 148 is a truss formed of a series of two bars 150 joined by a pin 152 through an opening in the center of each bar where the bars intersect to form an X The two side ends of each two bars, joined to form an X, are each joined to two side ends of adjacent two bars by pins 154 through openings 156 in the ends of the bars (see FIG. 15 for an example). This pattern is repeated until the necessary length is achieved. The two bars at each end of the scissor truss are joined to sleeves 156. A vertical rod 158 is attached to each frame member 13. The sleeves 156 fit over the rods at each end bar 158 of the hinged scissor truss 148 and allow for elongation and contraction of the hinged scissor truss 148. A locking mechanism 160 holds the scissor truss in a contracted or extended configuration. The locking mechanism 160 has a plate 162 attached at one end to scissor truss 148 by a pivot pin 164. The other end of plate 162 has a hole 166 for the insertion of pin 168. Pin 168 fits in openings 170 in pivots of scissor truss 148 to lock the truss in elongated on contracted configuration.

Another way of varying the width of the body lifting, turning and horizontally moving apparatus is to provide a collapsible hinged section in the end frame members as is shown in FIGS. 16 through 19. A first section 172 of each end frame member is rigidly attached to a corresponding side frame member 13 and extends to provide sufficient width to render the apparatus stable and not likely to tip over during movement. A vertically folding extension 173 is attached to an end of each first section 172 of each end frame member by a hinge pin 174 which extends through corresponding holes at first terminal ends in vertically folding extensions 173 and first sections 172. Preferably there are two vertically folding extensions 173 attached to an end of each first section 172. The two vertically folding extensions 172 in the extended state are preferably parallel and horizontal. The two vertically folding extensions 172 from one frame member 13 are joined at second terminal ends to second terminal ends of two vertically folding extensions from a second frame member 13 through a spacer bar 176. Pivot pins 178 extend through holes in second terminal ends of extensions 172 and corresponding holes in spacer bar 176.

Figure 19:
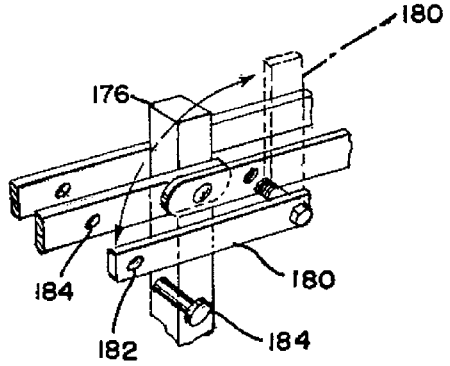
FIG. 19 is simply one method that can be used to lock the parallel arms in the open position by use of a strap pinned to two of the arms. This strap can be pivoted at one end to swing it out of the way when not in use.

A locking mechanism for holding the vertically folding extensions in the extended configuration is shown in FIG. 19. A locking plate 180 is pivotally attached to a vertically folding extension 173 on one side of spacer bar 176. A hole 182 in locking plate 180 mates with a corresponding hole 184 on the opposite side of spacer bar 176 when the vertically folding extension 173 is in its fully extended position. A pin 184 inserted through holes 182 and 184 holds vertically folding extension 173 in it fully extended position. Removal of the pin 184 allows the vertically folding extensions 173 to assume the contracted position shown in FIG. 18. The first section 172 of each side frame member 13 preferably extends perpendicular from the side frame members by a distance of from 6 inches to 18 inches to prevent the width of the frame being decreased to a width that would make it top heavy and likely to tip over during movement.

Figure 20:
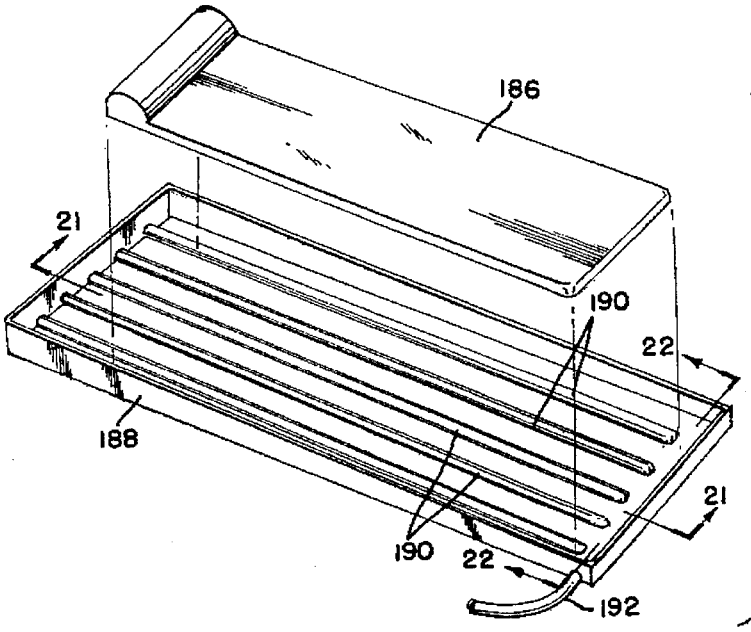
FIG. 20 is an exploded perspective view of a drain board and plastic inner cushion used in bathing bed patients showing strengthening fibs.
Figure 21:
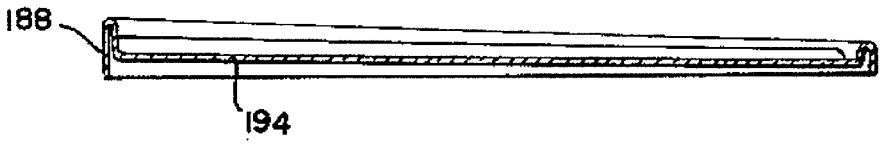
FIG. 21 is a longitudinal cross section of the drain board taken along lines 21—21 of FIG. 20 showing a sloped bottom.
Figure 22:
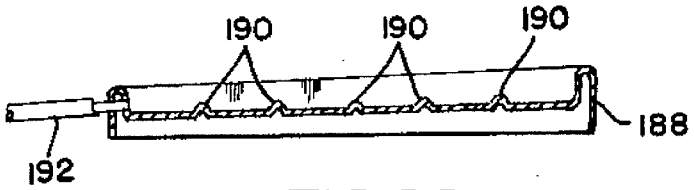
FIG. 22 is a cross sectional view taken along lines 22—22 of FIG. 20. This view shows how the bottom of the pan while sloping longitudinally, also slopes to one side at the foot end in order to drain the pan of waste water as the patient is being bathed.

The embodiments of the invention described above provide for the lifting of a patient for bathing or the moving of a patient for bathing. A completely portable bathing apparatus which allows the patient to be bathed in bed is shown in FIGS. 20 through 28. FIG. 20 shows a patient support cushion 186 to be positioned in drain pan 188. Patient support cushion 186 preferably has a width and length which is less than the inner dimensional width and length of the drain pan 188 to allow for water drainage from the patient around the cushion 186 and into drain pan 188. The cushion 186 is preferably covered with a waterproof plastic cover to facilitate cleaning. The cushion can also be made of a very fine closed cell foam, or a foam having a waterproof skin. The drain pan 188 can be made of stainless steel or high strength, lightweight plastic. Drain pan 188 preferably has longitudinal ribs 190 which strengthen the pan and improve waste water drainage. The pan 188 is drained through drain tube 192. The drain pan preferably has a bottom 194 which slopes downward longitudinally toward the drain tube 192 as in shown in FIG. 21 to facilitate drainage. The bottom 194 also slopes downwardly toward the side of the pan 188 having the drain tube as is shown in FIG. 22.

Figure 23:
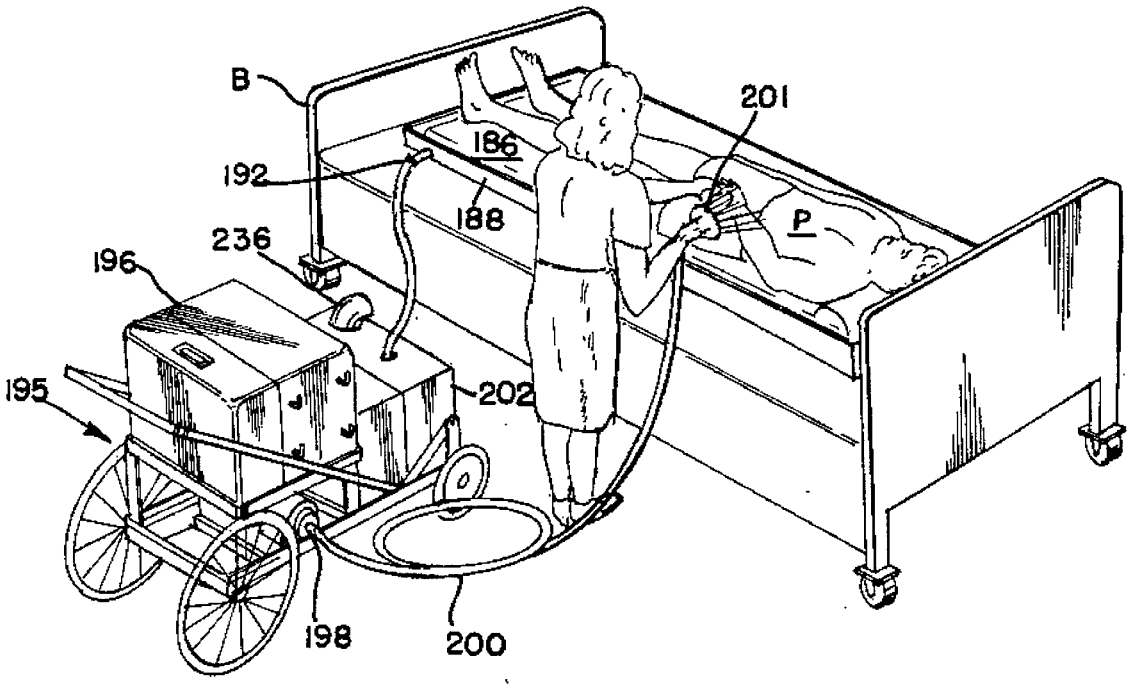
FIG. 23 is an overall perspective view of a bed patient being bathed by an attendant using the drain pan and cushioned liner. A cart, serving as a supply cart, source of water, and waste water collector is also shown in use at the side of the bed.
Figure 24:
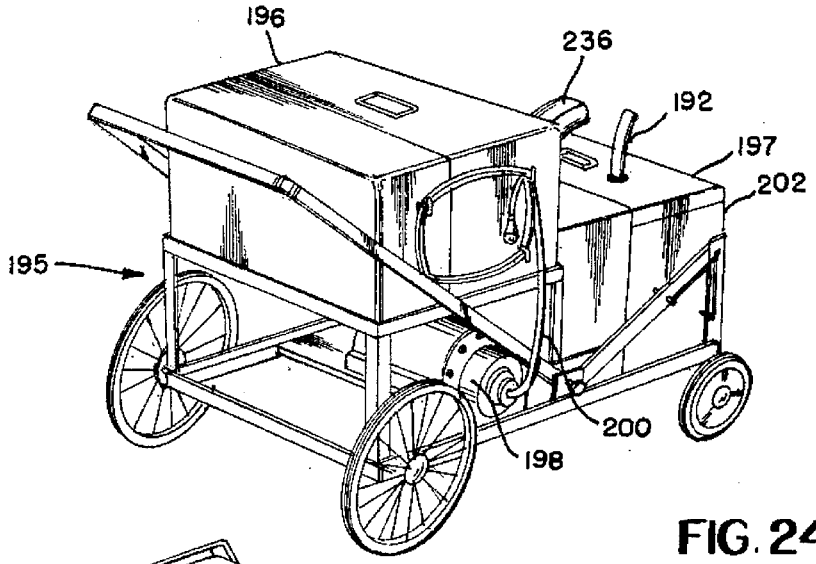
FIG. 24 is a perspective view of the rear of the cart shown in FIG. 23.
Figure 25:
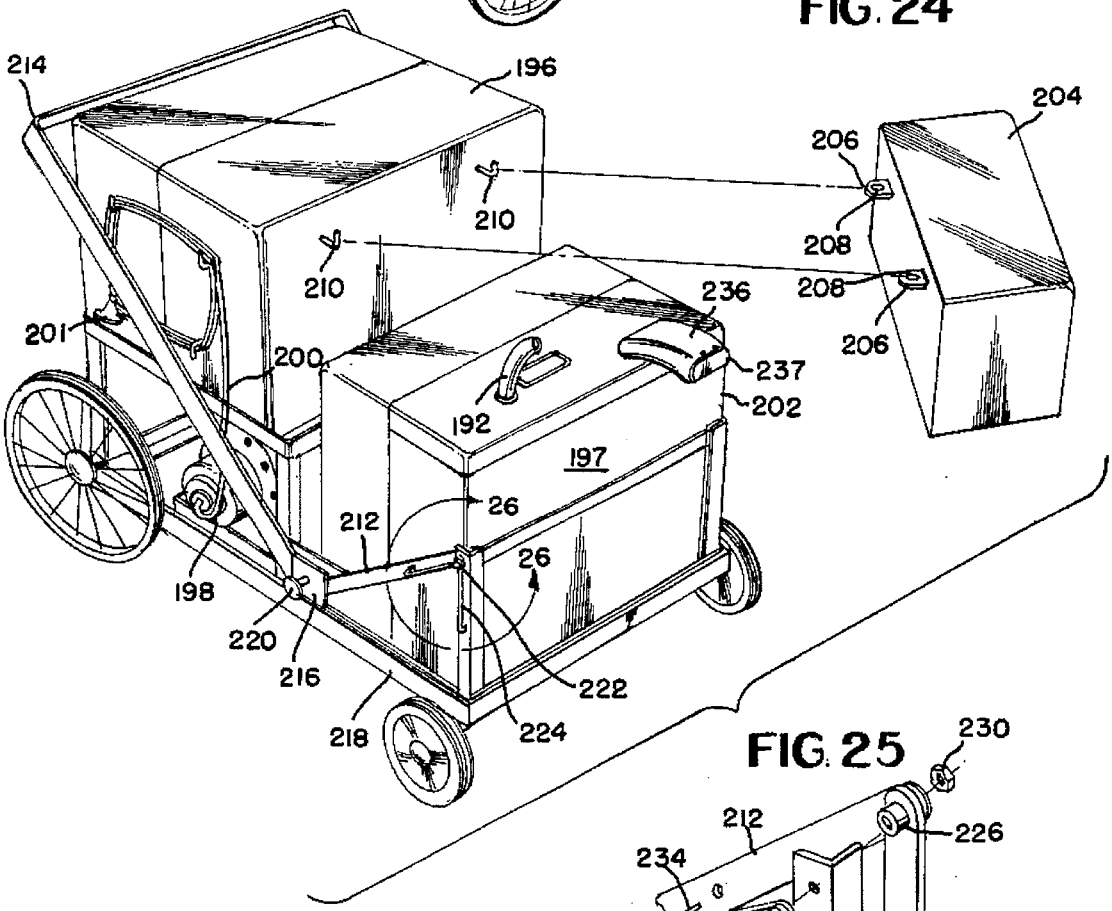
FIG. 25 is a partially exploded perspective view of the front end of the cart showing how one of the modular containers used for disinfectant can be removed from its hook like mounts.
Figure 26:
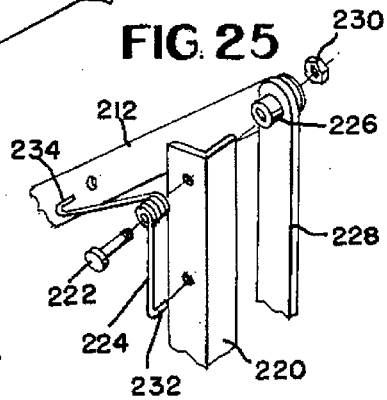
FIG. 26 is a fragmentary view of one of the pivots employed when the waste water is drained.
Figure 27:
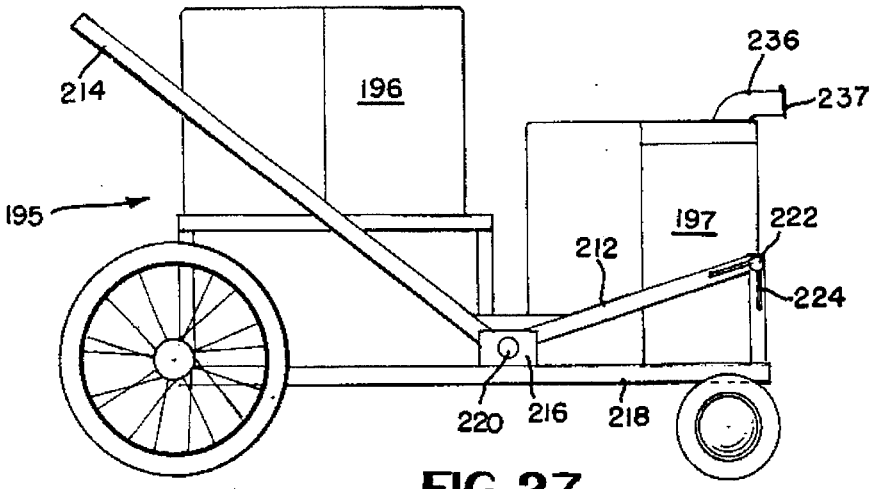
FIG. 27 is a side elevation of the cart.
Figure 28:
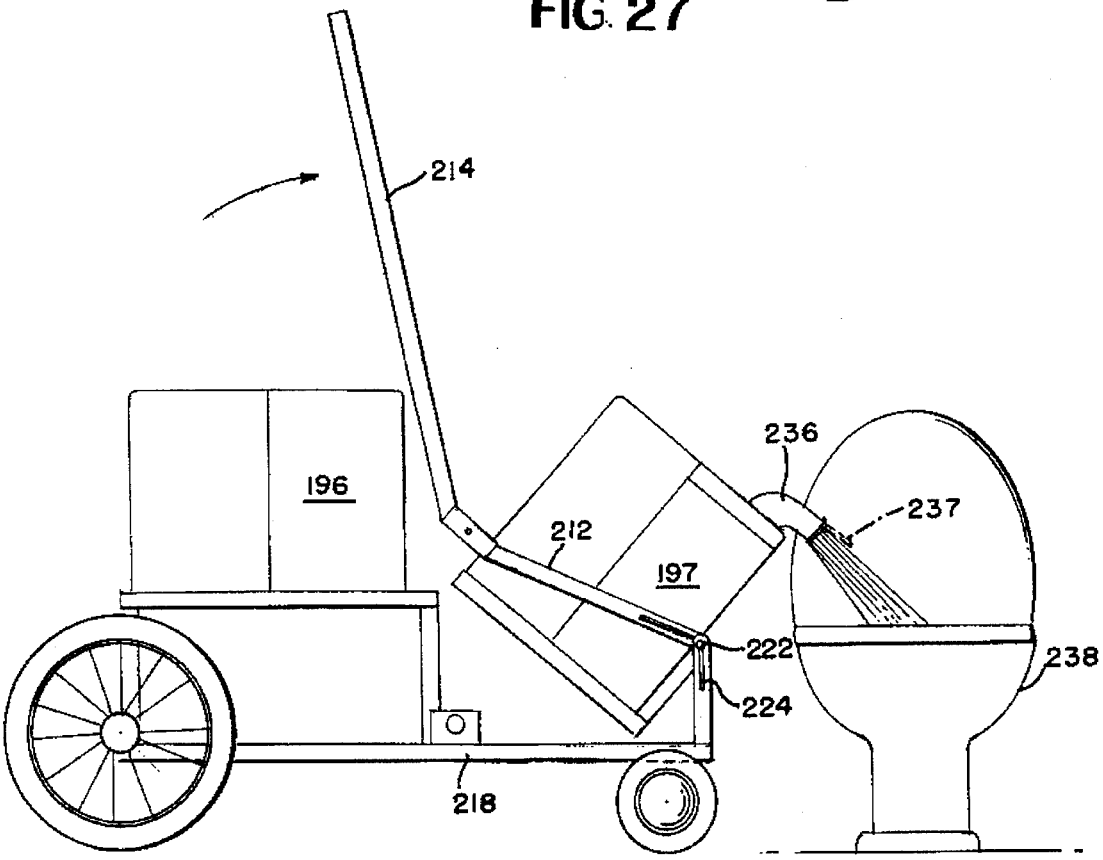
FIG. 28 is a side elevation of the cart showing how the handle is raised when emptying the waste water.

After the patient P is placed on cushion 186 in drain pan 188 on bed B, the lifting and turning apparatus 10 can be rolled away from the bed to facilitate bathing or left in place. FIG. 23 shows its removal. A cart 195 carries a warm, fresh, wash water supply in tank 196. Pump 198 pumps the wash water through hose 200 to spray nozzle 201 which is used by the attendant to scrub the patient. Drain water from pan 188 drains through drain tube 192 into waste water tank 197. The cart 195 is shown in greater detail in FIG. 24. As is shown in FIG. 25 a modular container 204 used for disinfectant can be suspended by flanges 206 having holes 208 from pins 210 extending from fresh water tank 196. The modular container 204 must be removed prior to the emptying of waste tank 202. Waste tank 202 is attached to tank frame member 212 which in turn is attached to cart handle 214. Both the cart handle 214 and the first end of tank frame member 212 are attached to frame flange 216 of cart frame 218 by a pin 220 which extend through cart handle 214, tank frame member 212 and frame flange 216. The second end of tank frame member 212 is pivotally attached to waste tank support bracket 220 through pivot pin 222. Pivot pin 222 also extends through compressed spring 224, bushing 226 and waste tank support bracket 228. Pivot pin 222 is threaded at one end and is held in place by nut 230. The two ends 232 and 234 of compressed spring 224 are bent at right angles and are inserted into holes in waste tank support bracket 232 and tank frame member 212 respectively. When it is desired to empty waste tank 202, pin 220 is removed. Spring 224 helps to lift waste tank 202. Lifting handle 214 causes tank frame member 212 to pivot about pivot pin 222 raising and tipping waste tank 202. The contents of waste tank 202 are emptied through discharge nozzle 236 having a free swinging hingerd cover 237 as shown in FIG.. 28 into a toilet bowl 238. The free swinging hinged cover 237 prevents odors from escaping from the waste water tank 197 in the event it sat around for any length of time before being emptied.

What is claimed is:

1. A body lifting apparatus, comprising:

(a) an open framework for being mounted on a bed;

(b) a horizontally extendable arm supported by the open framework, the extendable arm positioned above the bed and extendable beyond an edge of the bed.

(c) an elevator supported by the horizontally extendable arm, the elevator including a motor and a winding bar mounted on the extendable arm, the winding bar being rotationally driven by the motor, the winding bar being movable by the extendable arm beyond the edge of the bed for moving the body from the bed to another support structure;

(d) a winding line connected to the winding bar, whereby rotation of the motor in one direction winds the line onto the winding bar and rotation in the other direction unwinds the line and thereby raises and lowers the line;

(e) a patient support means for being positioned under the body, the patient support means being moved by the winding line.

2. A body lifting apparatus, comprising:

(a) an open framework for being positioned around a bed;

(b) a horizontally extendable arm supported by the open framework, the extendable arm positioned above the bed and extendable beyond an edge of the bed.

(c) an elevator supported by the framework, the elevator including a motor and a winding bar, the winding bar being rotationally driven by the motor;

(d) a winding line connected to the winding bar, whereby rotation of the motor in one direction winds the line onto the winding bar and rotation in the other direction unwinds the line and thereby raises and lowers the line, the line being movable by the extendable arm beyond the edge of the bed for moving the body from the bed to or from another support structure;

(e) a body support means for being positioned under the body, the body support means being raised or lowered or moved in a horizontal direction by the winding line.

3. The apparatus of claim 2 wherein the extendable arm rides on rollers.

4. The apparatus of claim 3 wherein the rollers are mounted on a roller support member affixed to the frame.

5. The apparatus of claim 3 wherein the rollers are mounted on the arm, a track is mounted on the frame and the rollers roll on the track.

6. The apparatus of claim 2 wherein the support means is a sheet and the sheet is held for lifting by clamps, each clamp having a housing in the shape of a "U" having an opening represented by the open side of the "U" and a curved section represent by the curved section of the "U", one large, flat inner surface of the clamp has a series of protrusions which provide a holding surface for the sheet, a tapered plate having a flat surface having a series of protrusions which oppose the protrusions on the housing to provide an opposing holding surface for the sheet, a carriage for the plate, the plate being slidable in the carriage and the carriage being slidable in the housing, a roller positioned in the end of the carriage at the direction of the opening of the "U", the roller forcing the tapered plate in the direction of the protrusions on the inner surface of the "U", the tapered plate being narrower in the direction of the opening in the "U" whereby movement in the direction of the opening causes the clamp to tighten, a shank attached to the carriage, the shank extending through the curved section of the "U", a spring which forces the shank in a direction away from the housing whereby the carriage is drawn away from the opening thereby causing the roller to move to a thicker portion of the tapered plate tightening the clamp.

7. The apparatus of claim 2 wherein rollers support the extendable arm and the extendable arm is extendable beyond the end of the frame.

8. The apparatus of claim 2 wherein a first section of each end frame member is rigidly attached to a corresponding side frame member and extends sufficiently to render the apparatus stable and not top heavy and likely to tip over during movement, hinges are positioned on an end of each first section of each of the end frame members, a vertically folding extension is attached at each end of the extension to the hinge positioned on an end of the end frame member to provide a vertically folding section which will provide for the extension and contraction of the width of the :frame for movement through narrow passageways.

9. The apparatus of claim 8 further characterized by a locking mechanism which holds the vertically folding extension in a restricted or expanded configuration.

10. The apparatus of claim 2 wherein a first section of each end frame member is rigidly attached to a corresponding side frame member and extends sufficiently to render the apparatus stable and not top heavy and likely to tip over during movement, rollers are positioned at top and bottom locations of each first section of each of the end frame members, the rollers being spaced a sufficient distance apart to accommodate a horizontally extendable frame member, a horizontally extending frame member inserted into opposing first sections of two end frame members to form an extendable end frame member which will provide for the extension and contraction of the width of the frame for movement through narrow passageways.

11. A body lifting apparatus, comprising:

(a) an open framework for being positioned around a bed;

(b) a horizontally extendable arm supported by the open framework, the extendable arm positioned above the bed and extendable beyond an edge of the bed;

(c) an elevator supported by the horizontally extendable arm, the elevator including a motor and a winding bar mounted on the extendable arm, the winding bar being rotationally driven by the motor, the winding bar being movable by the extendable arm beyond the edge of the bed for moving the body from the bed to another support structure;

(d) a winding line connected to the winding bar, whereby rotation of the motor in one direction winds the line onto the winding bar and rotation in the other direction unwinds the line and thereby raises and lowers the line;

(e) a patient support means for being positioned under the body, the patient support means being moved by the winding line.

12. The apparatus of claim 11 having first and second side frame members, each side frame member having two ends, a hinged scissor truss joined to one end of the first side frame member and to a corresponding end of the second side frame member, allowing the width of the end frames to be reduced for movement through restricted passageways.

13. The apparatus of claim 12 wherein the hinged scissor truss is joined to the frame member by a pin fitting into a grooved slot to allow the height of the hinged scissor truss to increase and decrease with a corresponding increase and decrease in the length of the hinged scissor truss.

14. The apparatus of claim 12 further characterized by a locking mechanism which holds the scissor truss in a reduced or expanded configuration.

15. The body lifting apparatus of claim 11 wherein the line is a strap.

* * * * *